US010132282B2

(12) United States Patent
Mechi et al.

(10) Patent No.: US 10,132,282 B2
(45) Date of Patent: Nov. 20, 2018

(54) FUEL RAIL ASSEMBLY

(71) Applicant: Continental Automotive GmbH, Hannover (DE)

(72) Inventors: Marco Mechi, Vada (IT); Daniel Marc, Leghorn (IT)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 159 days.

(21) Appl. No.: 14/415,396

(22) PCT Filed: Jul. 22, 2013

(86) PCT No.: PCT/EP2013/065374

§ 371 (c)(1),
(2) Date: Jan. 16, 2015

(87) PCT Pub. No.: WO2014/016231

PCT Pub. Date: Jan. 30, 2014

(65) Prior Publication Data

US 2015/0198128 A1 Jul. 16, 2015

(30) Foreign Application Priority Data

Jul. 23, 2012 (EP) ..... 12177448

(51) Int. Cl.
*F02M 63/02* (2006.01)
*F02M 55/02* (2006.01)
*F02M 61/14* (2006.01)

(52) U.S. Cl.
CPC ..... *F02M 63/0275* (2013.01); *F02M 55/025* (2013.01); *F02M 61/14* (2013.01);
(Continued)

(58) Field of Classification Search
CPC ..... F02M 2200/85; F02M 2200/855; F02M 2200/856; F02M 2200/857; F02M 63/0225; F02M 63/0275
(Continued)

(56) References Cited

U.S. PATENT DOCUMENTS 5,074,269 A 12/1991 Hethon et al. ..... 123/470
5,680,845 A 10/1997 Peng ..... 123/470
(Continued)

FOREIGN PATENT DOCUMENTS

CN 1462340 A 12/2003 ..... F02M 55/00
CN 1761814 A 4/2006 ..... F01M 39/02
(Continued)

OTHER PUBLICATIONS

European Search Report and Written Opinion, Application No. 12177448.3, 5 pages, dated Dec. 4, 2012.
(Continued)

*Primary Examiner* — Sizo Vilakazi
*Assistant Examiner* — Kevin R Steckbauer
(74) *Attorney, Agent, or Firm* — Slayden Grubert Beard PLLC

(57) ABSTRACT

A fuel rail assembly for a combustion engine includes a fuel rail, a plurality of fuel injector cups arranged and configured to face a cylinder head of a combustion engine and being hydraulically and mechanically coupled to the fuel rail directly or via pipe elements, and at least one support element configured to be fixedly coupled to the cylinder head. The at least one support element is fixedly coupled to two of the injector cups or to two of the pipe elements being coupled to the injector cups.

18 Claims, 3 Drawing Sheets

(52) U.S. Cl.
CPC . *F02M 2200/855* (2013.01); *F02M 2200/856* (2013.01); *F02M 2200/857* (2013.01)

(58) Field of Classification Search
USPC ..... 123/456, 468, 469, 470, 195 A
See application file for complete search history.

(56) References Cited

U.S. PATENT DOCUMENTS

| | | | | |
|---|---|---|---|---|
| 5,870,995 | A * | 2/1999 | Stockner | F02M 55/025 123/456 |
| 6,269,798 | B1 * | 8/2001 | Takahashi | F02M 61/14 123/469 |
| 6,405,713 | B1 * | 6/2002 | Scollard | F02M 55/004 123/468 |
| 6,889,660 | B2 * | 5/2005 | Usui | F02M 55/004 123/456 |
| 7,086,385 | B2 * | 8/2006 | Imoehl | F02M 51/005 123/470 |
| 7,188,609 | B2 * | 3/2007 | Watanabe | F02M 55/025 123/456 |
| 7,263,975 | B2 * | 9/2007 | Stieler | B29C 65/3656 123/456 |
| 7,334,572 | B1 * | 2/2008 | Diggs | F02F 7/006 123/195 C |
| 7,377,263 | B2 | 5/2008 | Muench et al. | 123/468 |
| 7,412,970 | B2 * | 8/2008 | Apel | F02M 61/14 123/470 |
| 7,874,282 | B2 * | 1/2011 | Ghelardi | F02M 55/005 123/456 |
| 8,096,277 | B2 | 1/2012 | Fornara et al. | 123/184.21 |
| 8,402,946 | B2 * | 3/2013 | Mehring | F02M 55/005 123/456 |
| 9,745,938 | B2 * | 8/2017 | Stahr | F02M 21/0278 |
| 2002/0029762 | A1 * | 3/2002 | Scollard | F02M 55/004 123/456 |
| 2004/0003798 | A1 | 1/2004 | Mutschler | 123/470 |
| 2004/0118382 | A1 * | 6/2004 | Usui | F02M 55/004 123/456 |
| 2006/0027214 | A1 * | 2/2006 | Watanabe | F02M 55/025 123/468 |
| 2006/0162144 | A1 * | 7/2006 | Stieler | B29C 65/0672 29/469.5 |
| 2006/0162697 | A1 * | 7/2006 | Stieler | B29C 65/3656 123/456 |
| 2006/0163243 | A1 * | 7/2006 | Stieler | B29C 65/3656 219/607 |
| 2006/0196478 | A1 * | 9/2006 | Apel | F02M 61/14 123/470 |
| 2008/0216798 | A1 * | 9/2008 | Ghelardi | F02M 55/005 123/470 |
| 2011/0094472 | A1 * | 4/2011 | Schreiner | F02M 55/025 123/294 |
| 2013/0340713 | A1 * | 12/2013 | Stahr | F02M 21/0278 123/456 |
| 2015/0198128 | A1 * | 7/2015 | Mechi | F02M 55/025 123/456 |
| 2017/0204825 | A1 * | 7/2017 | Batchelor | F02M 61/14 |

FOREIGN PATENT DOCUMENTS

| | | | | |
|---|---|---|---|---|
| CN | 101429907 | A | 5/2009 | F02M 35/104 |
| CN | 101644215 | A | 2/2010 | F02M 35/104 |
| CN | 201461071 | U | 5/2010 | F01L 1/06 |
| CN | 202082024 | U | 12/2011 | F02M 55/02 |
| DE | 102008044923 | A1 | 3/2010 | F02M 55/02 |
| WO | 2009/039021 | A1 | 3/2009 | F02M 55/00 |
| WO | 2014/016231 | A1 | 1/2014 | F02M 55/02 |

OTHER PUBLICATIONS

International Search Report and Written Opinion, Application No. PCT/EP2013/065374, 9 pages, dated Aug. 19, 2013.

Chinese Office Action, Application No. 201380039453.9, 15 pages, dated Jul. 4, 2016.

Chinese Office Action, Application No. 201380039453.9, 12 pages, dated Apr. 19, 2017.

* cited by examiner

FUEL RAIL ASSEMBLY

CROSS-REFERENCE TO RELATED APPLICATIONS

This application is a U.S. National Stage Application of International Application No. PCT/EP2013/065374 filed Jul. 22, 2013, which designates the United States of America, and claims priority to EP Application No. 12177448.3 filed Jul. 23, 2012, the contents of which are hereby incorporated by reference in their entirety.

TECHNICAL FIELD

The invention relates to a fuel rail assembly for a combustion engine.

BACKGROUND

Fuel rail assemblies for combustion engines are in widespread use, in particular for internal combustion engines. Fuel can be supplied to an internal combustion engine by the fuel rail through a fuel injector. The fuel rail can be coupled to the cylinder head in different manners.

In order to keep pressure fluctuations during the operation of the internal combustion engine at a very low level, internal combustion engines are supplied with a fuel accumulator to which the fuel injectors are connected and which has a relatively large volume. Such a fuel accumulator is often referred to as a common rail or a fuel rail. Known fuel rails may comprise a hollow body with recesses in form of fuel injector cups. Alternatively, the fuel injector cups may be coupled to the fuel rail by pipes. The fuel injectors are arranged in the fuel injector cups.

SUMMARY

One embodiment provides a fuel rail assembly for a combustion engine, the fuel rail assembly comprising: a fuel rail; at least four fuel injector cups, each of the fuel injector cups being arranged and configured to face a cylinder head of the combustion engine and being hydraulically and mechanically coupled to the fuel rail directly or via a respective pipe element; and at least a first and a second support element, each being configured to be fixedly coupled to the cylinder head; wherein the first and second support elements are spaced apart from each other; wherein the first support element is fixedly coupled to two first injector cups of the four injector cups or to respective two first pipe elements being coupled to the two first injector cups, respectively; and wherein the second support element is fixedly coupled to two second injector cups of the four injector cups, different from the first injector cups, or to respective two second pipe elements being different from the first pipe elements and being coupled to the second injector cups.

In a further embodiment, the two first pipe elements are positioned adjacent to each other and the two second pipe elements are positioned adjacent to each other, the first support element, by means of brazed or welded joints, is fixedly coupled to the two first pipe elements, and spaced apart from the two second pipe elements and from the two second fuel injector cups, and the second support element, by means of brazed or welded joints, is fixedly coupled to the two second pipe elements, and spaced apart from the two first pipe elements and from the two first fuel injector cups.

In a further embodiment, the first and second pipe elements are curved or bent in such fashion that the first and second fuel injector cups and the first and second support elements are laterally displaced with respect to a longitudinal axis of the fuel rail in top view along a mounting direction.

In a further embodiment, the first and second support elements are fixed to portions of the respective first and second pipe elements which extend parallel to the mounting direction and downstream of portions of the respective first and second pipe elements which extend obliquely or curved with respect to the mounting direction.

In a further embodiment, the first support element is arranged between the two first injector cups or between the two first pipe elements and the second support element is arranged between the two second injector cups or between the second first pipe elements.

In a further embodiment, the first support element has mirror symmetry with respect to a mirror plane extending between the two first pipe elements or first injector cups and the second support element has mirror symmetry with respect to a mirror plane extending between the two second pipe elements or second injector cups, the mirror planes being in particular parallel to a mounting direction of the fuel rail assembly.

In a further embodiment, the two adjacent first and/or second pipes or injector cups are arranged symmetrically to the respective mirror plane.

In a further embodiment, the fuel rail assembly comprises at least two fastening elements being configured to fixedly couple the first support element to the cylinder head and at least two further fastening elements being configured to fixedly couple the second support element to the cylinder head.

In a further embodiment, the fuel rail assembly comprises one, and only one, fastening element being configured to fixedly couple the first support element to the cylinder head and one, and only one, further fastening element being configured to fixedly couple the second support element to the cylinder head.

In a further embodiment, the fastening elements and further fastening elements are laterally displaced with respect to the fuel rail in such fashion that the fuel rail does not overlap the fastening elements and further fastening elements in top view along a mounting direction of the fuel rail assembly.

In a further embodiment, at least one of the fastening elements or further fastening elements is a screw.

BRIEF DESCRIPTION OF THE DRAWINGS

Example embodiments of the invention are explained in detail below with reference to the drawings, in which.

DETAILED DESCRIPTION

Figure 1:
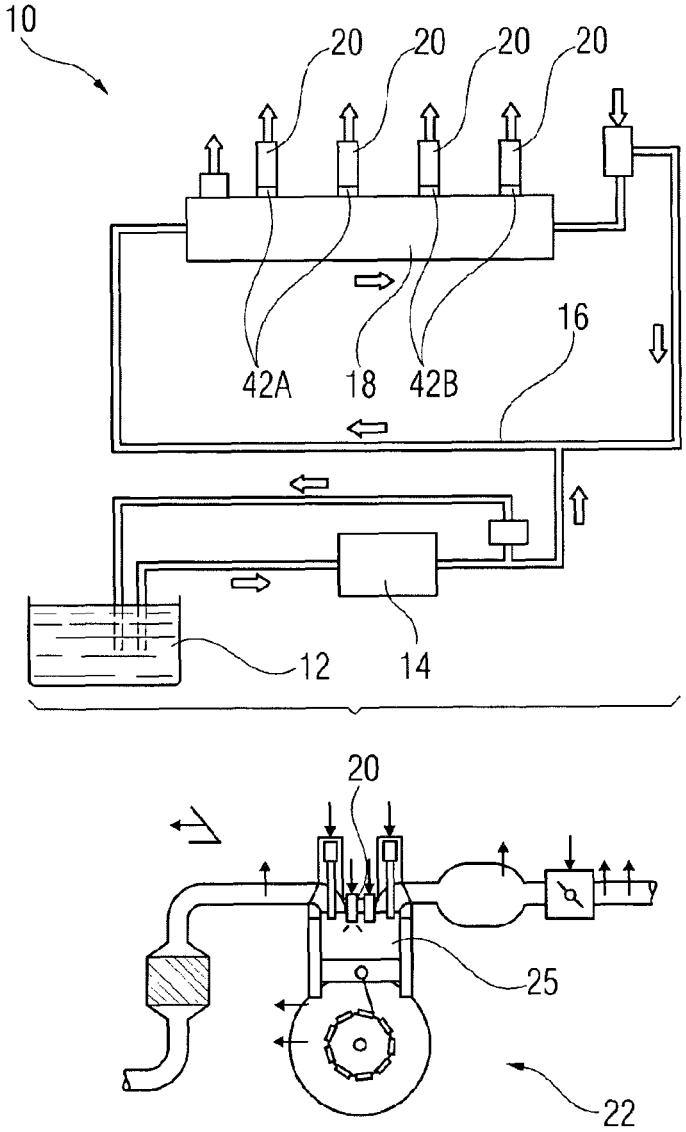
FIG. 1 shows an internal combustion engine in a schematic view.

Embodiments of the invention provide a fuel rail assembly for a combustion engine which is simply to be manufactured and which facilitates a reliable and precise coupling between the fuel rail and the cylinder head.

A fuel rail assembly for a combustion engine is specified. The fuel rail assembly comprises a fuel rail and a plurality of fuel injector cups. The fuel injector cups are in particular arranged and configured to face a cylinder head of a combustion engine.

In one embodiment, the fuel injector cups are hydraulically and mechanically coupled to the fuel rail directly. In another embodiment, each of the fuel injector cups is hydraulically and mechanically coupled to the fuel rail via a respective pipe element. Thus, the fuel rail assembly preferably has the same number of fuel injector cups and pipe elements, each of the pipe elements being assigned to exactly one of the fuel injector cups.

Preferably, the fuel rail assembly has at least four fuel injector cups. The number of fuel injector cups may correspond to the number of cylinders of the combustion engine. For example, the fuel rail assembly has two first injector cups and two second injector cups, different from the two first injector cups. In one development, the fuel rail assembly has two first pipe elements and two second pipe elements, different from the two first pipe elements. The two first pipe elements are coupled to the two first fuel injector cups and the two second pipe elements are coupled to the two second fuel injector cups.

Further, the fuel rail assembly has at least one support element being configured to be fixedly coupled to the cylinder head. The at least one support element is fixedly coupled to two of the injector cups or to two of the pipe elements being coupled to the injector cups. In the present context, two "fixedly coupled" parts are in particular immovable relative to each other. The at least one support element can also adjoin the fuel rail. In particular, it may additionally be fixedly coupled to the fuel rail, for example by a brazed or welded joint.

In one embodiment, the fuel rail assembly has a first support element and a second support element. The first and second support elements are preferably spaced apart from each other. In one embodiment, the first support element is fixedly coupled to the two first fuel injector cups or to the two first pipe elements and the second support element is fixedly coupled to the two second fuel injector cups or to the two second pipe elements.

In one development, the first support element, in particular by means of brazed or welded joints, is fixedly coupled to the first fuel injector cups or to the first pipe elements and spaced apart from the second fuel injector cups and preferably also from the second pipe elements. The second support element may be fixedly coupled, in particular by means of brazed or welded joints, to the second fuel injector cups or to the second pipe elements and is spaced apart from the first fuel injector cups and preferably also from the first pipe elements.

This fuel rail assembly has the advantage that the mechanical loads between the fuel rail and the injector cups or the pipe elements may be kept small. In particular, the at least one support element enables a balancing between momentums generated by the forces acting on the injector cups. Consequently, the size of the components of the fuel rail assembly may be kept small. Consequently, the costs of the fuel rail assembly may be low.

In one embodiment, the at least one support element is fixedly coupled to two adjacent injector cups or to two adjacent pipe elements. This has the advantage that the support element enables an equilibrium of forces between the momentums generated by the forces acting on the two adjacent injector cups. For example, the two first fuel injector cups are positioned adjacent to one another and the two second fuel injector cups may be positioned adjacent to one another. In one embodiment, the two first pipe elements are positioned adjacent to one another and the two second pipe elements are positioned adjacent to one another.

In one embodiment, the fuel rail extends along a longitudinal axis. The first and second pipe elements may be curved or bent. In particular, they are curved or bent in such fashion that the fuel injector cups and the support elements are laterally displaced with respect to the longitudinal axis, in particular in top view along a mounting direction. The mounting direction is in particular a direction perpendicular to the longitudinal axis of the fuel rail. With advantage, the support elements are easily accessible for mounting and unmounting the fuel rail assembly in this way.

For example, each of the pipe elements, in particular each of the first and second pipe elements, has a portion which extends parallel to the mounting direction, i.e. which enables a fluid flow parallel to the mounting direction, and a further portion, upstream thereof, which extends obliquely or curved with respect to the mounting direction. The first and second support elements are preferably fixed to the portions of the respective first and second pipe elements which extend parallel to the mounting direction, downstream of the further portions which extend obliquely or curved with respect to the mounting direction.

In a further embodiment the at least one support element is arranged between the two injector cups or between the two pipe elements. For example, the first support element is arranged between the two first injector cups or between the two first pipe elements and the second support element is arranged between the two second injector cups or between the second first pipe elements.

This has the advantage that the balancing between the momentums generated by the forces acting on the two injector cups may be realized in a very good manner. In an advantageous development, the support element or at least one of the support elements has mirror symmetry. In particular it has mirror symmetry with respect to a mirror plane which extends between the two adjacent pipe elements or injector cups to which the respective support element is fixedly coupled and to which the two adjacent pipe elements or injector cups are preferably arranged symmetrically. In particular, the mirror plane extends parallel to the mounting direction. In one development, the first support element has mirror symmetry with respect to a mirror plane extending between the two first pipe elements or first injector cups and the second support element has mirror symmetry with respect to a mirror plane extending between the two second pipe elements or second injector cups, the mirror planes being in particular parallel to a mounting direction of the fuel rail assembly.

In a further embodiment the fuel rail assembly comprises at least two fastening elements being designed to fixedly couple the at least one support element to the cylinder head. For example, the fuel rail assembly comprises at least two fastening elements being configured to fixedly couple the first support element to the cylinder head and at least two further fastening elements being configured to fixedly couple the second support element to the cylinder head. This has the advantage that a secure coupling between the at least one support element and the cylinder head may be obtained.

In a further embodiment the fuel rail assembly comprises one fastening element being designed to fixedly couple the at least one support element to the cylinder head. For example, the fuel rail assembly comprises one, and only one, fastening element being configured to fixedly couple the first support element to the cylinder head and one, and only one, further fastening element being configured to fixedly couple the second support element to the cylinder head. This has the advantage that only a small number of machining processes in the cylinder head has to be carried out to couple the support element to the cylinder head.

The fastening elements and further fastening elements are laterally displaced with respect to the fuel rail in such fashion that the fuel rail does not overlap the fastening elements and further fastening elements in top view along a mounting direction of the fuel rail assembly. The mounting direction is in particular a main extension direction of the fastening elements. With advantage, the fastening elements are easily accessible in this way.

In a further embodiment at least one of the fastening elements or further fastening elements is a screw. This has the advantage that the coupling between the fastening element and the cylinder head may be carried out in a simple manner.

A fuel feed device 10 is assigned to an internal combustion engine 22 (FIG. 1) which can be a diesel engine or a gasoline engine. It includes a fuel tank 12 that is hydraulically connected with a fuel pump 14. The output of the fuel pump 14 is connected to a fuel inlet 16 of a fuel rail 18. The fuel rail extends along a longitudinal axis L. In the fuel rail 18, the fuel is stored for example under a pressure of about 200 bar in the case of a gasoline engine or of about 2,000 bar in the case of a diesel engine.

A plurality of fuel injectors 20 is connected to the fuel rail 18 and the fuel is fed to the fuel injectors 20 via the fuel rail 18. The fuel injectors 20 are arranged in a cylinder head 24 of the internal combustion engine 22. Preferably, the fuel injectors 20 are not in direct contact with the cylinder head 24.

The fuel injectors 20 are suitable for injecting fuel into a combustion chamber 25 of the internal combustion engine 22. In an injection mode, fuel can flow through the fuel injectors 20 and may be injected into the combustion chamber 25. In a non-injecting mode a fuel flow through the fuel injectors 20 and an injection of fuel into the combustion chamber 25 is prevented.

Figure 2:
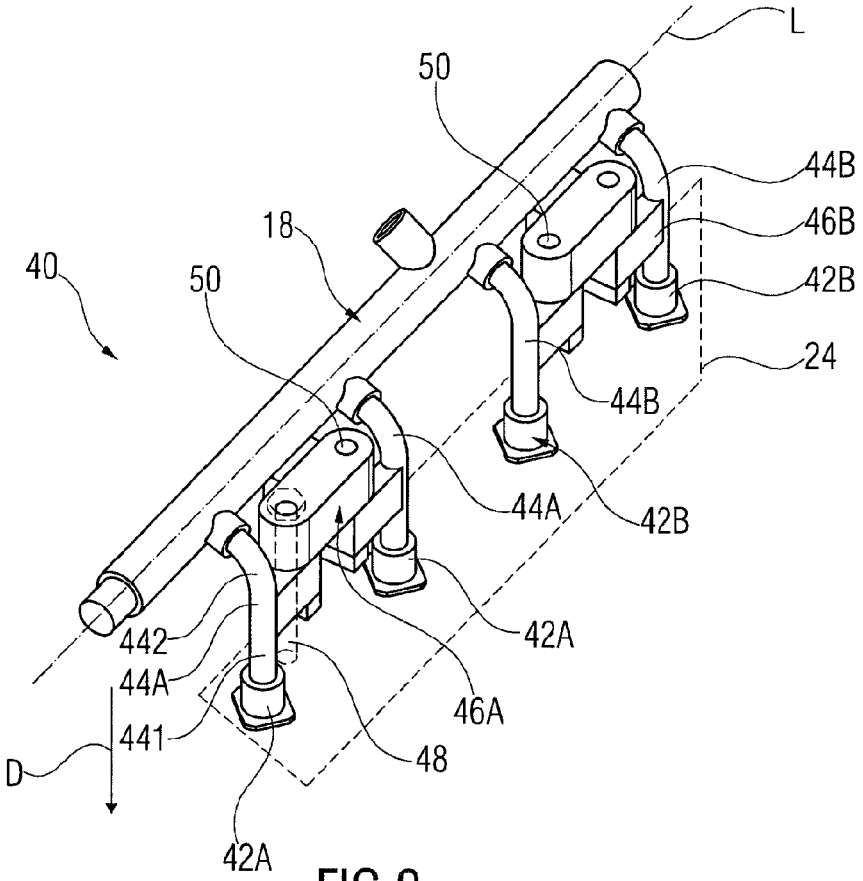
FIG. 2 shown a first embodiment of a fuel rail assembly in a perspective view.
Figure 3:
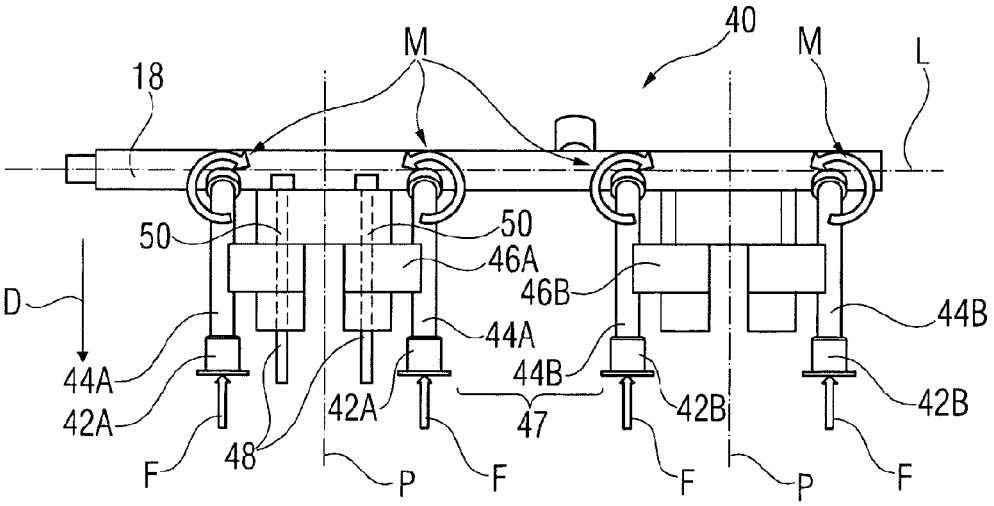
FIG. 3 shows the fuel rail assembly of FIG. 2 in a side view.
Figure 4:
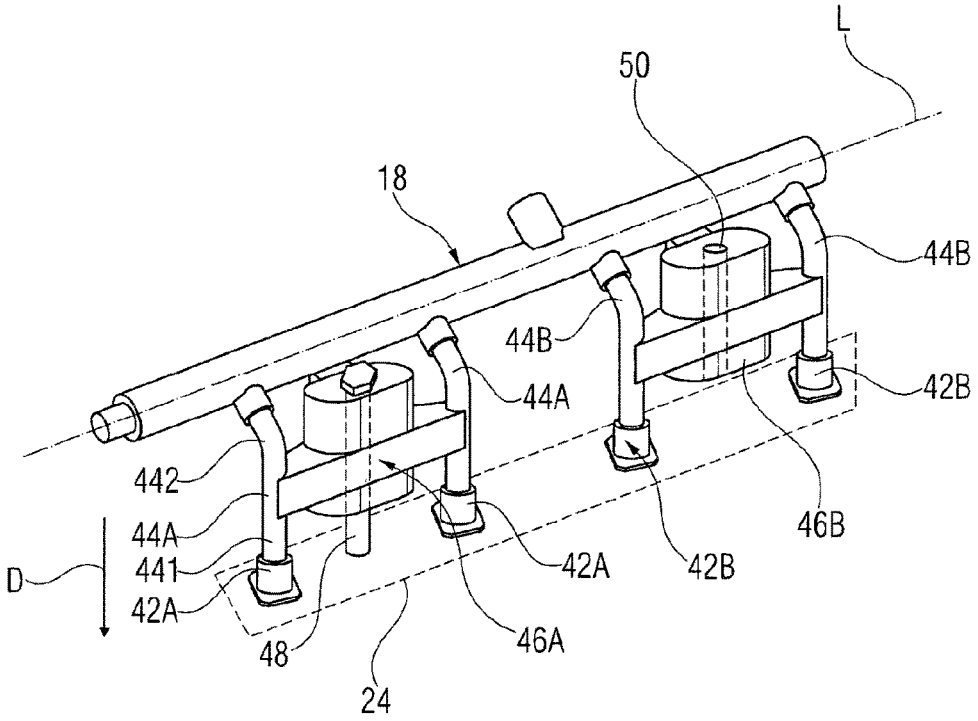
FIG. 4 shows a second embodiment of the fuel rail assembly in a perspective view.

FIGS. 2 to 4 show perspective views of fuel rail assemblies 40 according to a first exemplary embodiment (FIGS. 2 and 3) and according to a second exemplary embodiment (FIG. 4).

The fuel rail assembly 40 comprises a plurality of fuel injector cups 42A, 42B. The fuel injector cups 42A, 42B are in engagement with the fuel injectors 20. The fuel injector cups 42A, 42B are hydraulically and mechanically coupled to the fuel rail 18. The fuel injector cups 42A, 42B are arranged in a manner that they face the cylinder head 24 of the combustion engine 22.

In the shown embodiments the fuel injector cups 42A, 42B are mechanically and hydraulically coupled to the fuel rail 18 by pipes 44A, 44B. Each of the fuel injector cups 42A, 42B is coupled to one of the pipes 44A, 44B, for example it is fixed at an end of the pipe 44A, 44B. The pipes 44A, 44B enable a fluid flow from the fuel rail 18 via the fuel injector cups 42A, 42B to the respective fuel injector 20.

Each of the pipes 44A, 44B has a straight portion 441 which extends parallel to a mounting direction D of the fuel rail assembly 40 and a curved portion 442 upstream of the straight portion 441. In particular, the fuel injector cups 42A, 42B adjoin the respective straight portions 441 at a side opposite of the respective curved portions 442. By means of the curved portions 442, the straight portions 441—and, thus, the fuel injector cups 42A, 42B—are laterally displaced with respect to the fuel rail 18.

In a further embodiment the fuel injector cups 42A, 42B may be directly coupled to the fuel rail 18. For example, the fuel injector cups 42A, 42B are arranged in recesses of the fuel rail 18.

The fuel rail assembly 40 further comprises at least one support element 46A, 46B. In the shown embodiment the fuel rail assembly 40 has two support elements, a first support element 46A and a second support element 46B. The first and second support elements 46A, 46B are of the identical construction. The fuel rail assembly 40 further has four pipes, two first pipes 44A and two second pipes 44B. A respective fuel injector cup 42A, 42B is fixed to each of the pipes so that the fuel rail assembly 40 has two first fuel injector cups 42A, being fixedly coupled to the two first pipes 44A, and two second fuel injector cups 42B, being fixedly coupled to the two second pipes 44B.

The support elements 46A, 46B are shaped as brackets. The support elements 46A, 46B are fixedly coupled directly to the pipes 44A, 44B. The at least one support element 46A, 46B is arranged between the cylinder head 24 and two of the pipes 44A, 44B.

Specifically, the first support element 46A is fixedly coupled to the respective straight portions 441 of the two first pipes 44A by means of brazed or welded joints. It is spaced apart from the two second pipes 44B and from the two second fuel injector cups 42B. The second support element 46B is fixedly coupled to the respective straight portions 441 of the two second pipes 44B by means of brazed or welded joints. It is spaced apart from the two first pipes 44A and from the two first fuel injector cups 42A. The centers of gravity of the support elements 46A, 46B are laterally displaced with respect to the fuel rail 18 in this way. In particular, the support elements 46A, 46B do not have mirror symmetry with respect to a mirror plane defined by the longitudinal axis L and the mounting direction D.

In particular, a longitudinal gap 47 is defined by a distance between one first injector cup 42A, facing towards the second injector cups 42B and one second injector cup 42B, facing towards the first injector cups 42A (cf. FIG. 3). The longitudinal gap 47 is arranged between the first support element 46A and the second support element 46B in longitudinal direction L. The support elements 46A, 46B in particular to not overlap the longitudinal gap 47.

In addition, the first support element 46A may adjoin the fuel rail 18 at a longitudinal position between the longitudinal positions of the two first pipes 44A. The second support element 46B may adjoin the fuel rail at a longitudinal position between the longitudinal positions of the two second pipes 44B.

In an alternative embodiment, the support elements 46A, 46B are directly coupled to the injector cups 42A, 42B. In this embodiment, the at least one support element 46A, 46B may be arranged between the cylinder head 24 and two of the injector cups 42A, 42B.

In the present embodiment, each of the first and second support elements 46A, 46B has mirror symmetry with respect to a respective (imaginary) mirror plane P extending between the respective two adjacent first or second pipes 44A, 44B which are fixed with the respective support element 46A, 46B (cf. FIG. 3). Said two adjacent pipes 44A, 44B are arranged symmetrically to the mirror plane. The mirror planes P extend perpendicular to the longitudinal axis L and parallel to the mounting direction D which is parallel to the straight portions 441 of the first and second pipes 44A, 44B.

Preferably, the support elements 46A, 46B are coupled to the pipes 44A, 44B or to the injector cups 42A, 42B by brazing. Brazing may be carried out in a very good manner under the space conditions of the internal combustion engine 22. In a further embodiment, the support elements 46A, 46B may be coupled to the pipes 44A, 44B or to the injector cups 42A, 42B by welding.

In the embodiments as shown in FIGS. 2 to 4, the support elements 46A, 46B are fixedly coupled to two adjacent pipes 44A, 44B each hydraulically coupled to one of the injector cups 42A, 42B.

The fuel rail assembly 40 further comprises fastening elements 48 which are in engagement with the support elements 46A, 46B. In the embodiments shown in FIGS. 2 to 4, the fastening elements 48 are screws which allow a simple coupling of the support elements with the cylinder head 24. In further embodiments, the fastening elements 48 may be of a further type.

In the embodiment shown in FIGS. 2 and 3 each of the support elements 46A, 46B has two through holes 50. Each of the fastening elements 48 is arranged in one of the through holes 50 in the respective support element 46A, 46B. By this the support elements 46A, 46B can be fixedly coupled to the cylinder head 24. The mounting direction D in particular corresponds to the main extension direction of the support elements 48 when the support elements 48 are received in the through holes 50.

In the embodiment shown in FIG. 4 each of the support elements 46A, 46B has a single through hole 50 in which one of the fastening elements 48 is arranged.

In both embodiments, the fastening elements 48 are laterally displaced with respect to the fuel rail (18) in such fashion that the fuel rail (18) does not overlap the fastening elements (48) in top view along the mounting direction D of the fuel rail assembly 40. In this way, the fastening elements can easily be inserted in the through holes 50 sideways of the fuel rail 18 and are easily accessible for fixing the fuel rail assembly 40 to the cylinder head 24.

As shown in FIG. 3 forces F caused by fuel pressure and mechanical stress of the cylinder head 24 are acting on the fuel injector cups 42A, 42B. These forces F may cause momentums M in particular on the joints between the pipes 44A, 44B and the fuel rail 18. The momentums M are represented by semi-circular arrows in FIG. 3. The support elements 46A, 46B which are designed as brackets allow a balanced equilibrium between momentums M generated by the forces F acting on two adjacent fuel injector cups 42A, 42B. Consequently, mechanical loads between the fuel rail 18 and the pipes 44A, 44B or the fuel rail 18 and the fuel injector cups 42A, 42B can be kept small.

The support element 46A, 46B results in auto-equilibrated momentums M generated by the forces F acting on two adjacent fuel injector cups 42A, 42B of the fuel rail assembly 40. Therefore, momentums M that may generate torsion or bending in the joints between the pipes 44A, 44B and the fuel rail 18 may be avoided. Under particular conditions, forces in the joints between the fuel rail 18 and the pipes 44A, 44B may be reduced by about 40% in view of comparable load and pressure conditions. Consequently, the support element 46A, 46B may basically absorb transitional forces. Consequently, a high reliability of the joints between the fuel rail 18 and the pipes 44A, 44B may be obtained.

Consequently, the size of the components of the fuel rail assembly 40 such as the fuel rail 18 and the pipe elements 44A, 44B may be kept small. Consequently, low costs for the fuel rail assembly 40 may be obtained.

What is claimed is:

1. A fuel rail assembly for a combustion engine, the fuel rail assembly comprising:

a fuel rail, at least four fuel injector cups, each fuel injector cup arranged and configured to face a cylinder head of the combustion engine and being hydraulically and mechanically coupled to the fuel rail via a respective first, second, third, and fourth pipe element, and a first support element and a second support element, each of the first and second support elements configured to be fixedly coupled to the cylinder head with a connector passing through the respective support elements, wherein the first and second support elements are spaced apart from each other and laterally displaced and spaced apart from the fuel rail, wherein the first support element is brazed or welded to the first pipe element and to the second pipe element and not directly coupled to a first two of the at least four injector cups which are directly coupled to the first and second pipe elements, respectively, and wherein the second support element is brazed or welded to the third pipe element and to the fourth pipe element and not directly coupled to a second two of the at least four injector cups which are directly coupled to the third and fourth pipe elements, respectively.

2. The fuel rail assembly of claim 1, wherein:

the first and second pipe elements are positioned adjacent to each other and the third and fourth pipe elements are positioned adjacent to each other, the first support element is fixedly coupled to the first and second pipe elements by brazed or welded joints and spaced apart from the third and fourth pipe elements and from the two second fuel injector cups, and the second support element is fixedly coupled to the third and fourth pipe elements by brazed or welded joints and spaced apart from the first and second pipe elements and from the two first fuel injector cups.

3. The fuel rail assembly of claim 2, wherein the first and second pipe elements are curved or bent such that the first and second fuel injector cups and the first and second support elements are laterally displaced with respect to a longitudinal axis of the fuel rail in a top view along a mounting direction.

4. The fuel rail assembly of claim 3, wherein the first and second support elements are fixed to portions of the respective first and second pipe elements that extend parallel to the mounting direction and downstream of portions of the respective first and second pipe elements that extend obliquely or curved with respect to the mounting direction.

5. The fuel rail assembly of claim 1, wherein the first support element has mirror symmetry with respect to a mirror plane extending between the first and second pipe elements, and the second support element has mirror symmetry with respect to a mirror plane extending between the third and fourth second pipe elements, wherein the mirror planes are parallel to a mounting direction of the fuel rail assembly.

6. The fuel rail assembly of claim 5, wherein the two adjacent first and second pipes are arranged symmetrically to the mirror plane extending between the respective adjacent pipes.

7. The fuel rail assembly of claim 1, wherein the fuel rail assembly comprises:

at least two fastening elements configured to fixedly couple the first support element to the cylinder head, and at least two further fastening elements configured to fixedly couple the second support element to the cylinder head.

8. The fuel rail assembly of claim 1, wherein the fuel rail assembly comprises:

one, and only one, fastening element configured to fixedly couple the first support element to the cylinder head and one, and only one, further fastening element configured to fixedly couple the second support element to the cylinder head.

9. The fuel rail assembly of claim 7, wherein the fastening elements and further fastening elements are laterally displaced with respect to the fuel rail such that the fuel rail does not overlap the fastening elements and further fastening elements in a top view along a mounting direction of the fuel rail assembly.

10. The fuel rail assembly of claim 7, wherein at least one of the fastening elements or further fastening elements is a screw.

11. A combustion engine, comprising:

a fuel rail assembly comprising:

a fuel rail, at least four fuel injector cups, each fuel injector cup arranged and configured to face a cylinder head of the combustion engine and being hydraulically and mechanically coupled to the fuel rail via a respective first, second, third, and fourth pipe element, and a first support element and a second support element, each of the first and second support elements configured to be fixedly coupled to the cylinder head with a connector passing through the respective support elements, wherein the first and second support elements are spaced apart from each other and laterally displaced and spaced apart from the fuel rail, wherein the first support element is brazed or welded to the first pipe element and to the second pipe element and not directly coupled to a first two of the at least four injector cups which are directly coupled to the first and second pipe elements, respectively, and wherein the second support element is brazed or welded to the third pipe element and to the fourth pipe element and not directly coupled to a second two of the at least four injector cups which are directly coupled to the third and fourth pipe elements, respectively.

12. The combustion engine of claim 11, wherein:

the first and second pipe elements are positioned adjacent to each other and the third and fourth pipe elements are positioned adjacent to each other, the first support element is fixedly coupled to the first and second pipe elements by brazed or welded joints and spaced apart from the third and fourth pipe elements and from the two second fuel injector cups, and the second support element is fixedly coupled to the third and fourth pipe elements by brazed or welded joints and spaced apart from the first and second pipe elements and from the two first fuel injector cups.

13. The combustion engine of claim 12, wherein the first and second pipe elements are curved or bent such that the first and second fuel injector cups and the first and second support elements are laterally displaced with respect to a longitudinal axis of the fuel rail in a top view along a mounting direction.

14. The combustion engine of claim 13, wherein the first and second support elements are fixed to portions of the respective first and second pipe elements that extend parallel to the mounting direction and downstream of portions of the respective first and second pipe elements that extend obliquely or curved with respect to the mounting direction.

15. The combustion engine of claim 11, wherein the first support element has mirror symmetry with respect to a mirror plane extending between the first and second pipe elements, and the second support element has mirror symmetry with respect to a mirror plane extending between the third and fourth pipe elements, wherein the mirror planes are parallel to a mounting direction of the fuel rail assembly.

16. The combustion engine of claim 15, wherein the two adjacent first and second pipes are arranged symmetrically to the mirror plane extending between the respective adjacent pipes.

17. The combustion engine of claim 11, wherein the fuel rail assembly comprises:

at least two fastening elements configured to fixedly couple the first support element to the cylinder head, and at least two further fastening elements configured to fixedly couple the second support element to the cylinder head.

18. The combustion engine of claim 11, wherein the fuel rail assembly comprises:

one, and only one, fastening element configured to fixedly couple the first support element to the cylinder head and one, and only one, further fastening element configured to fixedly couple the second support element to the cylinder head.

* * * * *